US012290169B1

(12) United States Patent
Herrick et al.

(10) Patent No.: US 12,290,169 B1
(45) Date of Patent: May 6, 2025

(54) DRAWER GUIDE AND FURNITURE WITH DRAWER GUIDES

(71) Applicant: Ashley Furniture Industries, LLC, Arcadia, WI (US)

(72) Inventors: Jeremy Thomas Herrick, Whitehall, WI (US); Karl Joseph Fegi, Holmen, WI (US)

(73) Assignee: Ashley Furniture Industries, LLC, Arcadia, WI (US)

( * ) Notice: Subject to any disclaimer, the term of this patent is extended or adjusted under 35 U.S.C. 154(b) by 194 days.

(21) Appl. No.: 17/957,685

(22) Filed: Sep. 30, 2022

Related U.S. Application Data

(60) Provisional application No. 63/251,422, filed on Oct. 1, 2021.

(51) Int. Cl.
*A47B 88/43* (2017.01)

(52) U.S. Cl.
CPC ..... *A47B 88/43* (2017.01)

(58) Field of Classification Search
CPC ..... A47B 88/43
USPC ..... 312/334.28, 334.34, 334.36
See application file for complete search history.

(56) References Cited

U.S. PATENT DOCUMENTS

| | | | | | |
|---|---|---|---|---|---|
| 1,227,001 | A * | 5/1917 | Randall | A47B 88/493 | 312/334.44 |
| 2,653,852 | A * | 9/1953 | Bissman | A47B 88/497 | 312/334.36 |
| 2,785,939 | A * | 3/1957 | Hillson | A47B 88/40 | 312/334.5 |
| 3,909,078 | A * | 9/1975 | Riley | A47B 88/906 | 384/21 |
| 4,236,773 | A * | 12/1980 | Mertes | A47B 88/483 | 312/334.36 |
| 2003/0132688 | A1* | 7/2003 | Domenig | A47B 88/477 | 312/334.32 |

* cited by examiner

*Primary Examiner* — James O Hansen
(74) *Attorney, Agent, or Firm* — Christensen, Fonder, Dardi & Herbert PLLC; Douglas J. Christensen

(57) ABSTRACT

A molded drawer guide for seating of a drawer within a cabinet. The molded drawer glide having an attachment portion configured as a pad opposite a spacing portion, and with a gliding portion therebetween, all unitary and having a common downwardly facing bottom surface to seat on an upwardly facing horizontal surface of a cabinet at the drawer opening. The gliding portion being rounded for receiving lower side panel margins of the drawer. The attachment portion pad for receiving a single fastener for attachment to the cabinet. The spacing portion having a vertical face to abut a vertical surface of the cabinet at the drawer opening thereby in conjunction with the single fastener stabilizing the positioning of the drawer guide on the cabinet and having the fastener connection between the guide and the cabinet displaced horizontally from the gliding portion that the drawer side panels seat upon.

19 Claims, 7 Drawing Sheets

DRAWER GUIDE AND FURNITURE WITH DRAWER GUIDES

CROSS-REFERENCE TO RELATED APPLICATION

This application claims the benefit of U.S. Provisional Application No. 63/251,422, filed Oct. 1, 2021, the disclosure of which is incorporated by reference herein in its entirety.

FIELD OF THE DISCLOSURE

The present disclosure relates to installing drawers in cabinets. More specifically, the present disclosure relates to components providing a low friction surface upon which a drawer may glide.

BACKGROUND

Many furniture items have drawers, such as chests of drawers, dressers, night stands, china cabinets, and the like. Each of the drawers are typically slidingly affixed to an interior of a cabinet of the furniture item using one or two drawer slides. A "drawer slide" may be an assembly of cooperating components, typically always including a rail attached to the cabinet, and an interfacing component attached to the drawer. Drawer slides may be attached in pairs with one of the pair attached to each side panel of the door and to the cabinet. A single, centrally mounted drawer slide positioned under the drawer and extending between the front and rear of the cabinet provides an efficient and inexpensive means of affixing a drawer to cabinets. The side mounted drawer slides, generally require twice as much hardware per drawer, may be slower and less efficient to properly lineup and affix to a cabinet, and cost more. The public generally expects simple furniture to operate optimally and last for many years. Once drawers stop operating optimally in furniture pieces, the users may become disenchanted with the brand of the furniture and the entire piece of furniture may be discarded as repairing such items is not within the capabilities of most of the consuming public. Extending the useful life of such furniture pieces with drawers, so that they operate optimally for an extended period of time, without the need of repair, would be of benefit to the consuming public and to the goodwill of furniture manufacturers. To the extent such improvement is done inexpensively, such would be a benefit to the furniture industry.

SUMMARY

Assembly of furniture pieces known as case goods, often have drawers, such as a chests of drawers, dressers, and night stands. Such furniture items may conveniently utilize drawer slides and drawer guides. A common configuration has a cabinet with drawer openings in a front panel of the cabinet sized to accommodate the drawers. Each drawer having a drawer slide mounted below the respective drawer. Each drawer slide having a fixed rail mounted in the interior of the cabinet, extending from the front of the cabinet to the rear of the cabinet, and positioned below the respective drawer. Another cooperating rail, guide, or sliding brackets are attached to the bottom of each drawer, the rail, guide, or brackets interfacing with the respective fixed rail, allowing the drawer to travel along and over the rail.

A drawer of such furniture piece typically has two side panels, a front panel opposite a rear panel, and a bottom panel therebetween. The bottom panel tends to be slightly offset upwardly from lower margins of the side panels. In some configurations, this permits room to mount the cooperating hardware that permits the drawer to travel on the centrally mounted rail. A long recognized problem with furniture pieces having the single rail mount is that the single rail provides the drawer some opportunity to twist and rotate as it is pulled out and pushed in, generally speaking, a lack of stability, particularly compared to side mounted pairs of drawer slides. In the single drawer slide configurations the side panels may rub on portions of the cabinet, such as surfaces at the drawer opening of the cabinet front panel during operation.

As shown in Prior Art FIGS. 1A-1F, known polymer drawer guides may be used as a buffer between wooden drawer components and wooden cabinet components in such single center mounted drawer slide installations, providing a bearing surface for the lower edge surface of the drawer side panels. Such polymer guides provide stability and a reduced friction interface between the drawer and cabinet.

The inventors have identified drawbacks associated with such conventional polymer drawer guides used in association with single center mounted drawer slides. The prior art polymer drawer guide components can be easily affixed on the cut out portion of the cabinet front panel below the drawer side panels and will function reasonably well for a period of time. However, such conventional known guides have a less than optimal life expectancy, which is directly related to the useful life of the furniture piece, and said optimal life expectancy may be dependent upon the correct and precise installation of the polymer drawer guide. For example, in the Prior Art guides shown in FIGS. 1A-1F, and other known guides, a relatively large portion of the guide defines the drawer contact surface. A generally flat pad is provided that does not have a discrete localized bearing surface; rather the load from the weight of the drawer may be positioned on the forward edge or the rearward edge or a lateral edge of the flat pad of the drawer guide. Or the load may move about the pad as the drawer is slid in and out, particularly where the single central mounted drawer slide has some "play" therein and doesn't tightly constrain the drawer open and close pathway. The specific loading on the pad may also depend directly upon how the guide is mounted and thus can vary from guide to guide in the same piece of furniture and from one furniture piece to another like furniture piece. Further, the fastener that attaches the guide to the front panel cutout is often positioned within the flat pad, where the lower surface of the drawer side panel makes contact with the guide. Over extended periods of time, particularly where the drawer is filled with heavy contents, the drawer loading may tend to loosen the guide fastener and guide on the cabinet effecting the smooth operation of the drawer. Additionally, over time, conventional guides tend to crack near the central fasteners, also effecting the operation of the drawer. As the guide fasteners work themselves loose, it may merely rub on the drawer side panel, causing a degradation in performance, or the edge of a screw head or nail may embed itself in the drawer side panel, thereby rendering a drawer completely inoperable. The inventors have identified and addressed these issues with embodiments herein.

Embodiments herein include a molded drawer guide for seating of a drawer within a cabinet. The molded drawer glide having an attachment portion configured as a pad opposite a spacing portion, and with a gliding portion therebetween, all unitary and having a common downwardly facing bottom surface to seat on an upwardly facing horizontal surface of a cabinet at the drawer opening. The gliding portion being rounded for receiving lower side panel margins of the drawer. The attachment portion pad for receiving a single fastener for attachment to the cabinet. The spacing portion having a vertical face to abut a vertical surface of the cabinet at the drawer opening thereby in conjunction with the single fastener stabilizing the positioning of the drawer guide on the cabinet and having the fastener connection between the guide and the cabinet displaced horizontally from the gliding portion that the drawer side panels seat upon.

In embodiments, a molded polymer drawer guide for aligning a center mounted drawer within a cabinet includes an attachment portion opposite a spacing portion defining a gliding portion there between. The attachment portion, spacing portion, and gliding portion unitary with one another and have a common downward facing planar surface. The drawer guide having a longitudinal axis. The spacing portion may be further configured to abut the vertical inward facing surface of the front cabinet panel at the drawer cut out. The attachment portion configured as a pad and a single aperture may extend through the attachment portion, the aperture configured to receive a fastener such as drawer glide mounting screw. The gliding portion has an arcuate upward facing surface extending between a first edge portion of the downward facing planar surface to an opposite edge portion of the downward facing planar surface. The gliding portion having a constant cross section taken perpendicular to the longitudinal axis of the guide, with the arcuate upward facing surface at the top of the cross section. The spacing portion includes a cabinet panel contact face perpendicular to the downward facing planar surface.

In embodiments, the spacing portion may include a drawer contact face opposite the cabinet panel contact face. The spacing portion may have a sloped edge portion with a recess. The recess providing improved moldability of the drawer guide as well as a reduction in polymer material. In embodiments, the single aperture is countersunk. In embodiments, the arcuate upward facing surface of the gliding portion has an apex centered between first and opposite second edges of the downward facing planar surface. In embodiments, the apex of the gliding portion is flush with an upward facing surface of the attachment portion.

In embodiments of the invention, a length of the gliding portion is more than double a length of the attachment portion. In embodiments, a length of the gliding portion is more than double a length of the spacing portion. In embodiments, a length of the attachment portion is greater than a length of the spacing portion. In embodiments, a length of the attachment portion is no more than 50% greater than a length of the spacing portion. In embodiments, the drawer guide has a generally "L" shaped profile.

In embodiments, a furniture item includes a cabinet portion with a plurality of stacked drawers therein. The cabinet is formed from a pair of wood product side wall panels, a rear panel extending between the side wall panels, and a front panel with openings for receiving the plurality of stacked drawers. Each of the plurality of stacked drawers has a centrally mounted drawer slide positioned beneath a bottom panel and attaching the respective drawer to the cabinet by way of a cooperating slide member. Each drawer has two side panels, where each of the side panels extends downwardly from the bottom panel. Each of the downwardly extending side panels has a downwardly facing contact face configured to slide across a polymer drawer glide secured to the cabinet. The polymer drawer glide has a front panel attachment end and a side wall panel engagement end. The drawer glide further includes an arcuate body portion extending between the attachment end and the engagement end. The sidewall panel engagement end has a flat contact face configured to abut one of the pair of cabinet side wall panels.

In embodiments, the polymer drawer glide is secured to the cabinet with a single connection. In embodiments, the engagement end of the polymer drawer guide includes a countersunk aperture. In embodiments, a screw received through the aperture secures the polymer drawer guide to the front panel of the cabinet.

In embodiments, the front panel of the cabinet includes one or more cross members. In embodiments, the one or more cross members abuts the cabinet side wall panels such that the front panel openings are generally rectangular. The polymer drawer guides are configured to fit into each of the lower corners of the rectangular front panel openings. Accordingly, when the attachment portion is fastened to the cross member, contact between the sidewall panel and the flat contact face of the polymer drawer guide prevents the polymer drawer guide from rotating about the fastener.

In embodiments, a first coefficient of friction between the polymer drawer guide and the drawer side panels is less than a second coefficient of friction between the drawer side panels and the cabinet. In embodiments, the engagement end extends upwardly from the arcuate body portion such that the side panel of the drawer is prevented from contacting the side wall panel of the cabinet.

A method of installing a molded drawer guide includes: providing a molded drawer guide; abutting the cabinet panel contact face of the spacing portion along a sidewall of the cabinet; aligning the downward facing planar surface along the cross-member of the cabinet; and driving a screw through the single aperture of the attachment portion and into the cross-member.

The method of installing the molded drawer glide may further include: providing a second molded drawer guide; aligning the downward facing planar surface along the cross-member of the cabinet; abutting the cabinet panel contact face of the spacing portion along an opposite sidewall of the cabinet; and driving a screw through the single aperture of the attachment portion of the second molded drawer guide and into the cross-member.

A feature and advantage of embodiments, is that by a reconfiguration of a very inexpensive component of a furniture piece with drawers, the useful life of said component and consequently said furniture piece may be dramatically extended. In embodiments of the invention, a more robust drawer guide is less likely to loosen, is less likely to fracture, may be installed easily without reduced on no significant criticality associated with the installation.

Features and advantages of embodiments of the invention include a drawer slide system that includes a central single drawer slide and a pair of drawer guides as disclosed herein. The central single drawer slide comprising a rail for attachment to a cabinet below a drawer opening, a rail or bracket for attachment to the drawer and that cooperates with the rail for attachment to the cabinet.

A feature and advantage of the disclosure is positioning fasteners on guides in locations where they will not be an impediment to the operation of the drawer, particularly if they become loosened. A feature and advantage of embodiments is that the loading of the drawer on the guide is displaced from the guide fastener, reducing potential failure modes associated with the loading of the guide on a pad with the fastener centered in the pad. A feature and advantage of the disclosure is minimizing contact between contact surfaces of moving and stationary components. A feature and advantage of embodiments is that the contact surface for engaging the drawer is convex rather than a flat pad. The convex surface having an axis extending parallel to an elongate axis of the guide and perpendicular to the in and out path of the drawer. In embodiments the axis of the radius of curvature at an apex of the glide portion is positioned below the guide. In embodiments the radius of curvature of the convex engagement surface is greater than 10 mm. The contact surface having an arcuate shape in cross section perpendicular to the elongate axis and the axis of curvature of the drawer contact surface.

A feature and advantage of embodiments is that providing a convex surface with an axis perpendicular to the in and out travel of the drawer provides a contact at the apex of the contact surface, wherein the loading of the guide from the weight of the drawer and contents is centered on the guide, and directly above the longitudinal axis of the guide. With the fastener displaced from the contact surface, the stresses that urge loosening and potential damage to the guide region of conventional guides with fasteners are effectively eliminated. Moreover, the criticality of mounting position is minimized. In embodiments, the glide portion is longer than the width of the drawer side panel which it engages, providing lateral tolerance. Additionally, whether the guide is mounted proximate to the interior vertical surface of the cabinet front panel, or proximate to the exterior surface of the cabinet front panel, or centered therebetween, does not affect the functionality or the stresses on the guide.

A feature and advantage of embodiments is that positioning of the guide on the upper surface of the cross member of the cabinet panel is non-critical. In conventional flat pad drawer guides if the pad is not perfectly flat, the drawer can engage a forward or rearward edge of the drawer guide which can provide increased friction. This issue is eliminated by the convex elongate contact surface.

A feature and advantage of embodiments is extending the useful life of furniture pieces with drawers by providing drawer guides that are more reliable, longer lasting, having less criticality associated with installation, and less likely to loosen and become dislocated. A feature and advantage of the disclosure is the ability to stabilize and improve function of drawers in furniture pieces where the drawers have centrally mounted single drawer slides.

The above summary is not intended to describe each illustrated embodiment or every implementation of the present disclosure.

DETAILED DESCRIPTION

FIGS. 1A-1F illustrates prior art drawer guides 10, 12, 14, 16, 18, and 20 that may be utilized in furniture having drawers with center mounted drawer slides.

Figure 10:
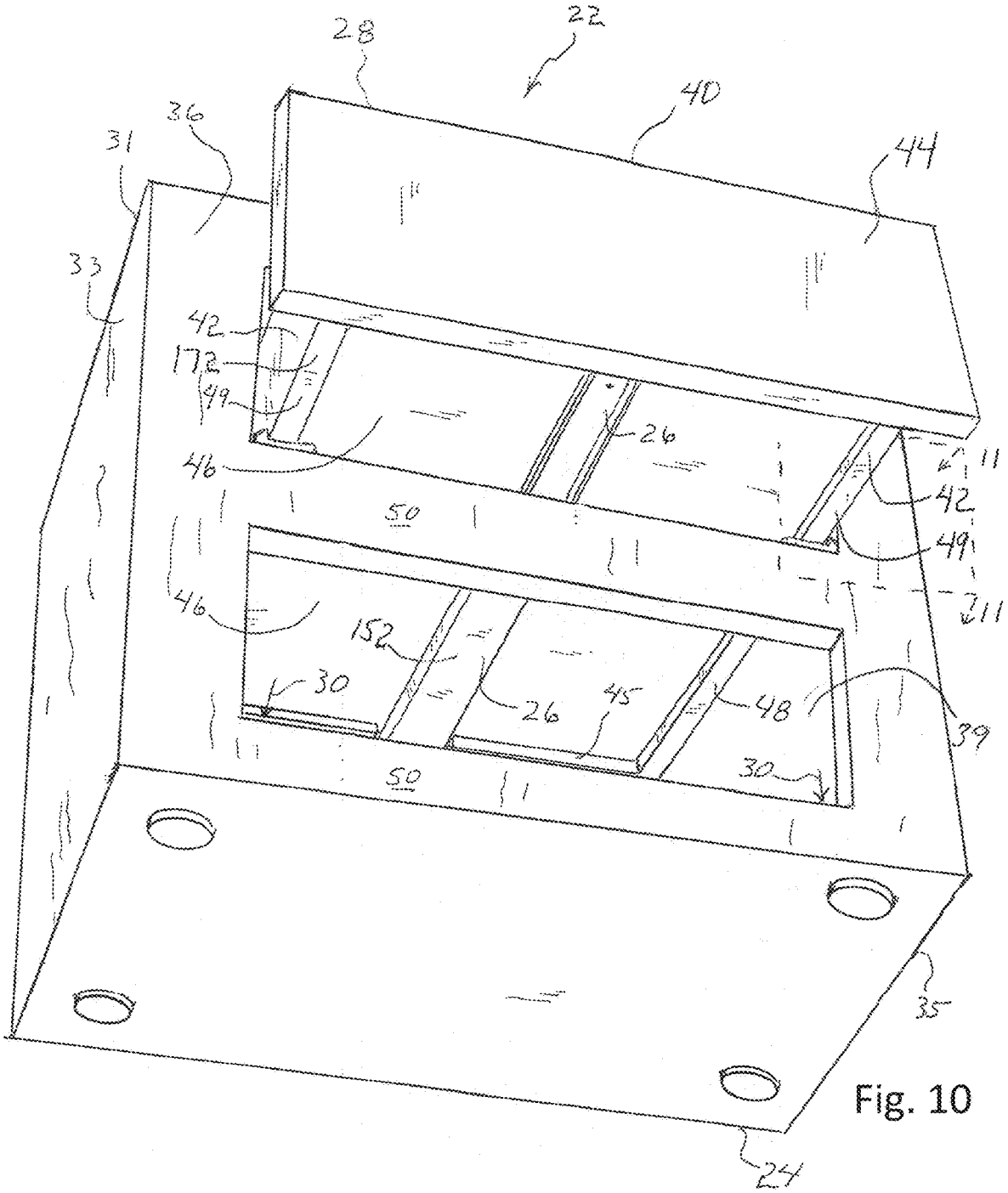
FIG. 10 is an upwardly looking perspective view of a furniture item according to an embodiment of the disclosure.

Referring to FIG. 10, an exemplary furniture item 22 configured having a cabinet 24 with a center mounted drawer slide 26 attached to the cabinet and to a drawer 28 is illustrated. Drawer guide mounting locations are indicated by arrows 30. The cabinet 24 generally has a top panel 31, a pair of side panels 33, 35, and a front panel 36. Front panel 36 has a plurality of drawer openings 39, each sized to receive a drawer 40. The drawer 40 has two side panels 42, a front panel 44 opposite a rear panel 45, and a bottom panel 46 therebetween. The bottom panel 46 may be lightly offset upwardly from lower margins 48 of the side panels, the lower margins defining downwardly facing surfaces 49 that engage the drawer guides. The drawer guides are conventionally placed on the upper faces, not shown in this view, of the cross members 50 of the front panel 36 of the cabinet. Drawer guides 100 are positioned between the drawer 40 and the cabinet 24

Figure 1A:
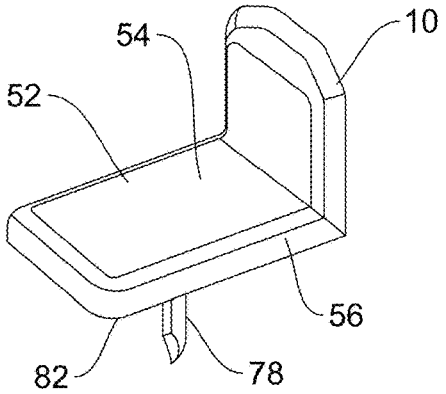
PRIOR ART FIG. 1A
FIG. 1A is a perspective view of a prior art drawer guide.
Figure 1B:
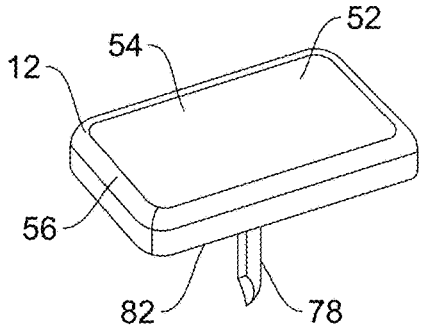
PRIOR ART FIG. 1B
FIG. 1B is a perspective view of another prior art drawer guide.
Figure 1C:
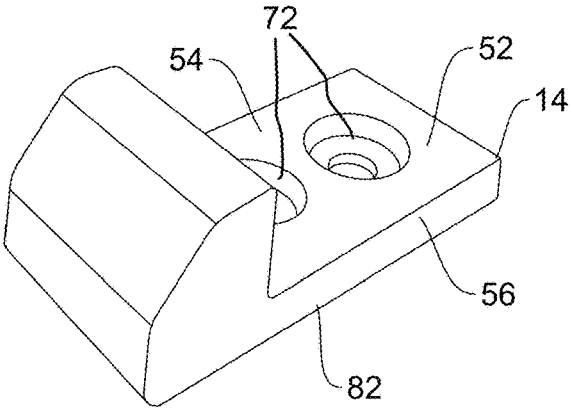
PRIOR ART FIG. 1C
FIG. 1C is a perspective view of another prior art drawer guide.
Figure 1D:
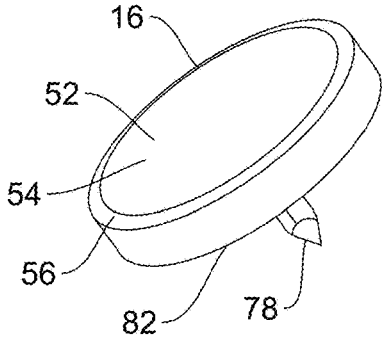
PRIOR ART FIG. 1D
FIG. 1D is a perspective view of another prior art drawer guide.
Figure 1E:
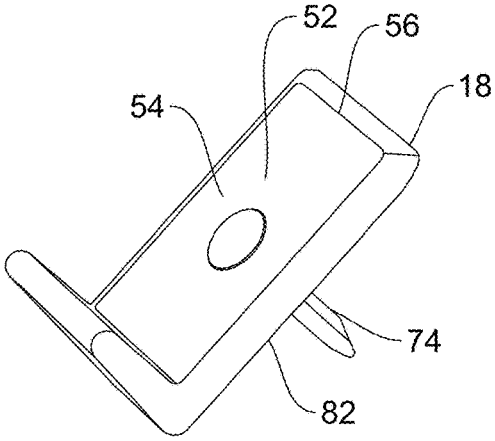
PRIOR ART FIG. 1E
FIG. 1E is a perspective view of another prior art drawer guide.
Figure 1F:
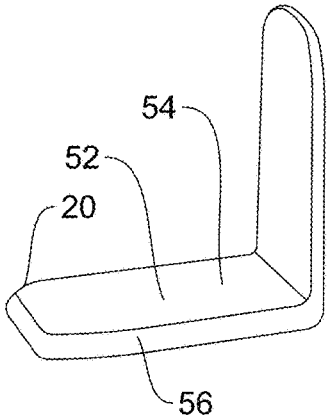
PRIOR ART FIG. 1F
FIG. 1F is a perspective view of another prior art drawer guide.

Referring again to FIGS. 1A-1F, prior art drawer guides generally all have a drawer engaging pad 52 with a flat upwardly facing drawer contact face 54 with a perimeter 56. Several known prior art guides have an upright projection 60 that provides a vertical contact face 64 that operates as a lateral constraint for the drawer, see specifically guides 10, 14, 18, 20. The prior art guides 14, 18 of FIGS. 1C and 1E have a centrally located mounting aperture 72 for receiving a screw or nail 74. The prior art guides 10, 12, 16 of FIGS. 1A, 1B, and 1D have an embedded nail or prong 78. The pad of FIG. 1F may be attached with adhesives and/or staples. The guide of FIG. 1D is a circular pad. The flat contact faces 54 comprise the majority of the area of the prior art guides when viewed from above. The perimeter 56 of each pad 52 defines the drawer contact surface and substantially defines the downwardly facing mounting surface 82 of the guide. The flat drawer contact face 54 provides a large contact surface area between prior art drawer guides and the drawer. This effectuates a load point on the contact surface that may move about the contact surface as the drawer is opened and closed. Such movement of the load point can effectuate stresses on the guide and eventually cause loosening of the fastener, whether a screw, nail or embedded prong. Further, the relative short length of contact face 11 in conjunction with the generally centrally positioned mounting aperture 80 on some of the guides causes the drawer to come in contact with regions 82 of the pad surrounding the mounting aperture 80. The region surrounding the mounting aperture 13, or the embedded prong, has proven to be a weak point in drawer guides that tends to crack over time. See FIG. 1C. Such cracks 83 in contact face 54 cause abrasions increasing the coefficient of friction between contact face 54 and a drawer. Further, cracks can propagate and cause failure of the guide. In some instances, a loosened screw head may embed in a drawer surface causing the drawer to become inoperable.

FIGS. 2-9 depict a molded polymer drawer guide 100 according to embodiments of the disclosure. Drawer guide 100 is illustrated having an attachment portion 101 configured as a pad 102 and a spacer portion 103. A glide portion 105 extends between attachment portion 101 and spacer portion 103. Downwardly facing planar surface 107 may extend the entire length of drawer guide 100. Drawer guide 100 has a first edge 111 opposite a second edge 113. First and second side edge portions 111, 113 are generally parallel to longitudinal axis 109 of the drawer guide. An outside end edge 115 of attachment portion 101 extends between first and second side edge portions 111, 113. In embodiments, outside end edge 115 is arcuate. In alternative embodiments, outside end edge 115 may be a variety of shapes. For example, outside edge 115 could be straight and form generally right angles with first and second side edge portions 111, 113. Attachment portion 101 configured as a pad 102 may further include an upwardly facing flat or planar surface 117. Upwardly facing surface 117 may include an aperture 119 configured to receive a fastener such as a screw. In embodiments, aperture 119 may have a countersink 120. In embodiments without an aperture, the attachment portion 101 may receive a fastener that punctures or otherwise extends therethrough, for example, on or more staples. Positioning of the attachment portion displaced from the glide portion and the spacer portion reduces stresses on the guide at the connection between the guide and the cabinet reducing failures of the guide as well as potential loosening or failure of the connection.

Glide portion 105 has a convex upwardly facing surface 121, configured as a partial cylindrical surface, extending between first and second edges 111, 113. An apex 122 of glide portion 105 extends along a line and may be flush with or offset from upwardly facing planar surface 117 of attachment portion 101. The glide portion having a uniform cross section taken in a plane perpendicular to the axis 109 of the guide 100 for the length of the glide portion 105.

Spacer portion 103 includes a vertical cabinet panel contact face 123 extending between first and second edges 111, 113. The cabinet panel contact face 123 is orthogonal to downward facing planar surface 107. Opposite to cabinet panel contact face 123, and projecting upwardly from glide portion 105, is drawer contact face 125. Contact face 125 peaks at top surface 127. Such a gap ensures that the drawer cannot rub on side panels of the cabinet. For a more appealing overall aesthetic, front panels secured to the drawer can cover gaps between the drawer and cabinet. Forward edge 128 extends between top surface 127 and cabinet panel contact face 123. In embodiments, forward edge 128 slopes downwardly from top surface 127 to contact face 123. In embodiments, the drawer contact face 125, top surface 127, and forward edge 128 define an upward projection 130 of the spacer portion 103. In embodiments, forward edge 128 defines recess 131. Eliminating excess material, such as through a sloped instead of rectangular shape, or a recess, can have molding advantages, minimizing deformations during the molding process, and saving expense in that less polymer is required.

Figure 2:
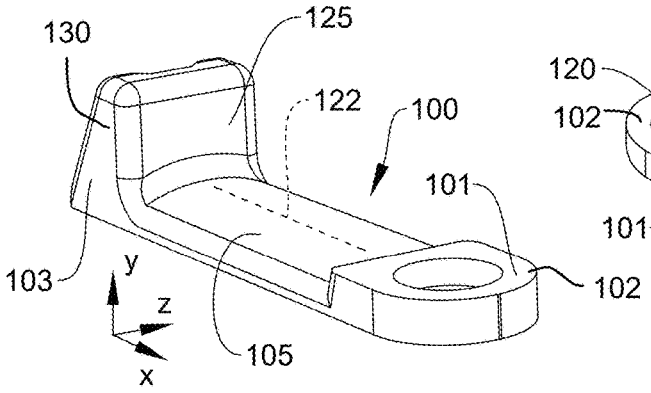
FIG. 2 is a perspective top view of a drawer guide according to an embodiment of the disclosure.
Figure 3:
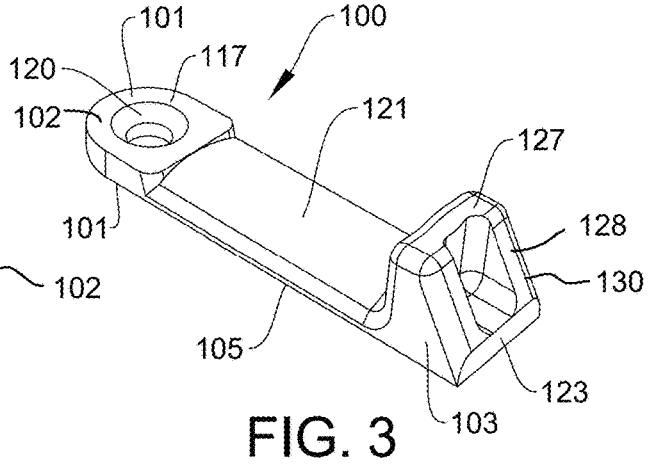
FIG. 3 is a perspective top view of the drawer guide of FIG. 2 taken from an opposite side.
Figure 4:
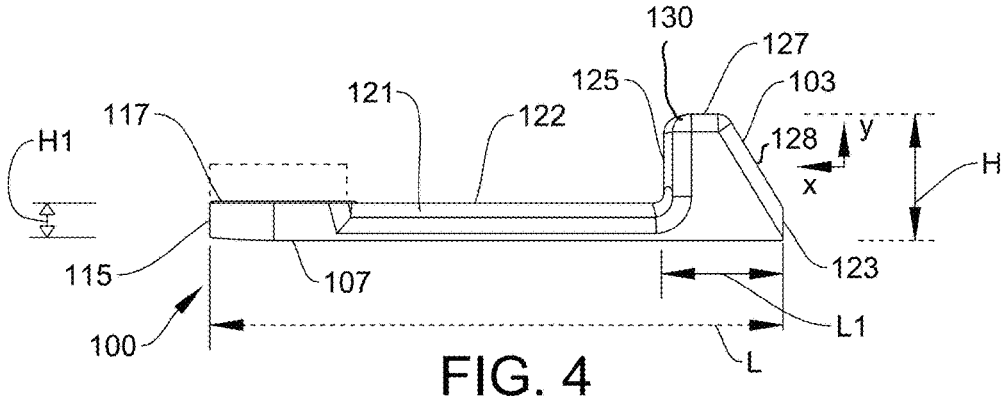
FIG. 4 is a side elevation view of a drawer guide according to an embodiment of the disclosure.
Figure 5:
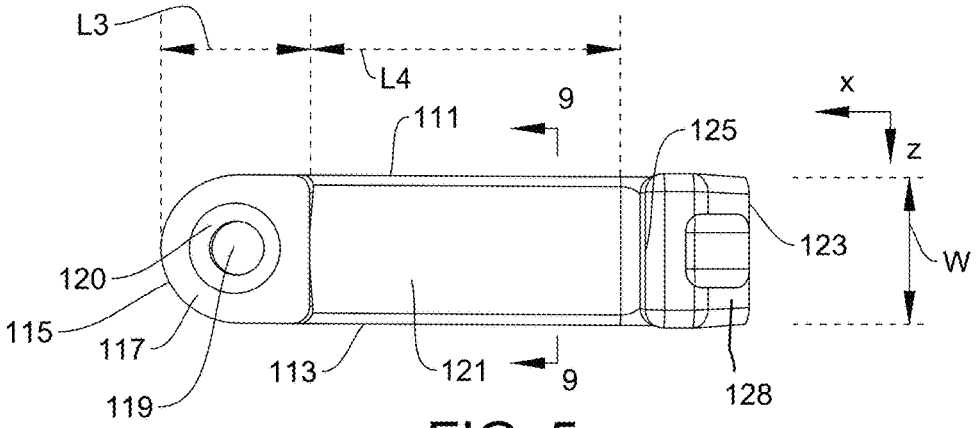
FIG. 5 is a top plan view of a drawer guide according to an embodiment of the disclosure.
Figure 6:
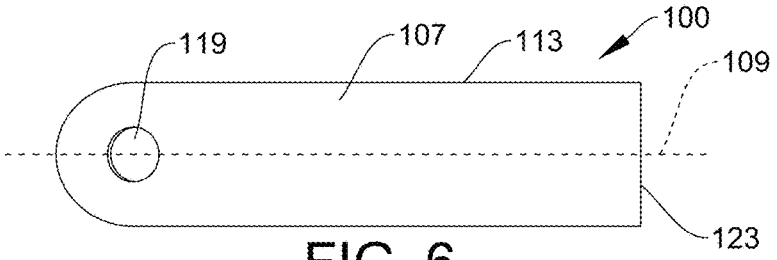
FIG. 6 is a bottom plan view of a drawer guide according to an embodiment of the disclosure.
Figure 7:
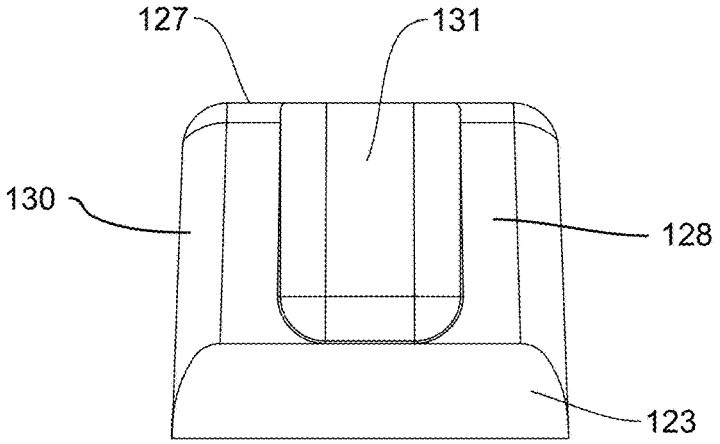
FIG. 7 is an elevation view of an end of a drawer guide according to an embodiment of the disclosure.
Figure 8:
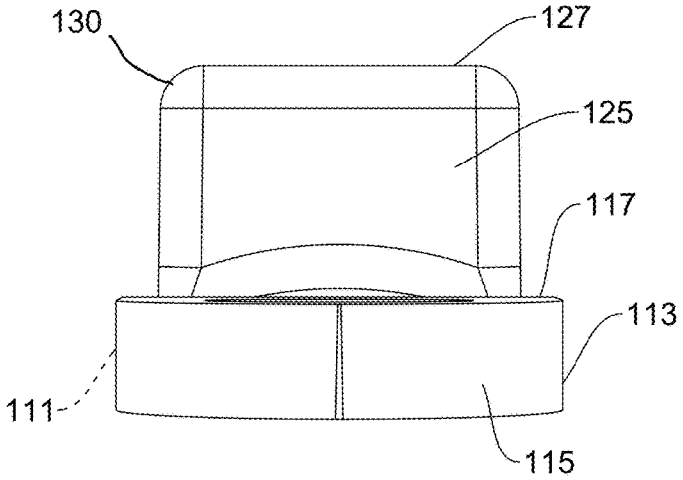
FIG. 8 is an elevation view of the drawer guide of FIG. 7 taken from an opposite end.

Referring to FIGS. 2, 4, and 5, an x-y-z coordinate system is depicted as part of the specific figures for purposes of clarity and illustration. The x axis is in the direction of the greatest dimension of the guide, that is, the length L, which may, in embodiments be in the range of 40 mm to 60 mm. In embodiments, the guide length L may be in the range of about 35 to 70 mm. In embodiments, the length L may be in the range of 45 to 65 mm. The y axis is in the direction of the height H of the guide and, in embodiments the height His in the range of 10 to 15 mm. In embodiments, the height H is in the range of about 8 to 20 mm. In embodiments, the height H is in the range of about 11 to 14 mm. In embodiments the height H1 of the glide portion and the attachment portion is in the range of about 1-5 mm. In embodiments the spacer portion does not project upwardly, with the height H of the guide may be in the range of 2-5 mm. The z axis is in the direction of the width W of the guide 100. In embodiments, the width W of the guide 100 is 12 to 15 mm. In embodiments the width W of the guide is in the range of about to 20 mm. In embodiments, the length L is the greatest dimension of the guide, the width W is the second greatest dimension of the guide, and the height H is the third greatest dimension of the guide. In embodiments the downwardly facing planar surface 107 extends the full length L of the guide and the full width W of the guide. In embodiments, a length L1 of the spacer portion 103, as measured between cabinet panel contact face 123 and drawer contact face 125 ensures that there is a sufficient gap between the drawer and cabinet. In embodiments the spacer portion length L1 may be 9 to 11 mm. In embodiments the length L1 may be about 8 to 13 mm. In embodiments, a length L3 of the attachment portion may be in the range of 12 to 15 mm. In embodiments, the length L3 may be in the range of about 10 to 20 mm. In embodiments, a length L4 of the glide portion may be in the range of 25 to 32 mm. In embodiments, the length L4 may be in the range of about 15 to 38 mm.

Figure 9:
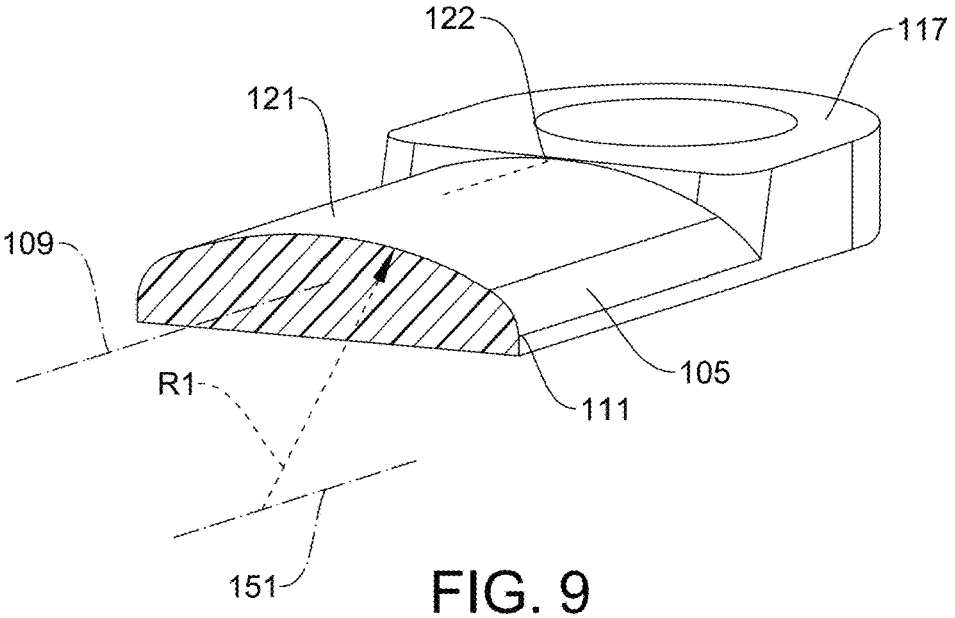
FIG. 9 is a cross sectional view of a drawer guide taken at line 9-9 of FIG. 5.

Referring to FIG. 9, the convex surface 121 of the glide portion 105 has a radius of curvature R1 with an axis 151 of the curvature displaced below the glide portion radius and parallel to the longitudinal axis 109 of the guide. In embodiments the radius of curvature extends a distance that is more than the height H1 of the glide portion. In embodiments, the radius of curvature R1 is in the range of 10 mm to 18 mm. In embodiments, the radius of curvature R1 is in the range of about 8 m to 35 mm.

In embodiments, the guide does not extend below the downwardly facing planar surface 107, that is it only mounts to the top surface of the cabinet at the drawer opening and may also engage the cabinet by butting up against the vertical surface of the cabinet at the drawer opening. The lowermost planar surface providing a datum level for the heights of the various portions.

One skilled in the art will appreciate that a molded drawer guide 100 may be manufactured through known methods such as injection molding. Common materials for injection molded components include thermoplastics and thermosetting polymers. For example, polyethylenes, polypropylenes, polyesters, nylons, fluoropolymers, polyvinylchlorides, polystyrenes, and other polymers and copolymers may be suitable. The polymer utilized may also have additives and fillers to provided desirable characteristics. Although plastics are referenced, other materials or combinations of materials are not beyond the scope of this scope of this disclosure. For example, a drawer guide 100 may be metallic and still present certain benefits as described herein.

Figure 11A:
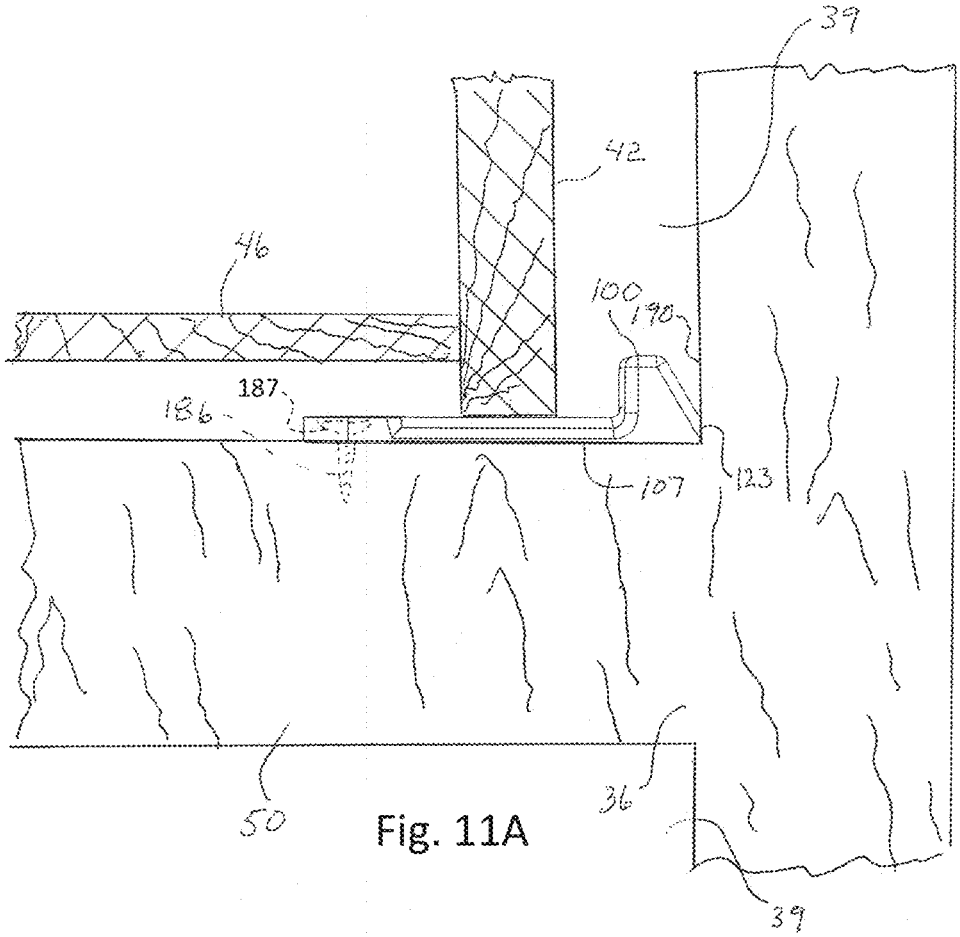
FIG. 11A is a partial cross sectional view of the mounted drawer guide interfacing with a drawer taken at plane 11-11 of FIG. 10.

Referring to FIGS. 10 and 11A the exemplary furniture item 24 with drawers has a cabinet with two rectangular drawer openings 39 with a drawer 40 having a center drawer slide 26 and elongate polymer drawer guides 100 positioned in the upper drawer opening 39 in the cabinet. The lower drawer opening as illustrated does not have a drawer therein exposing a fixed rail portion 152 of the center drawer slide 26. Drawer 400 includes a pair of side panels 33, 35, front panel 44, rear panel 45, and drawer bottom panel 46. In embodiments, the lower margins 172 of the drawer side panels 33, 35 extend downwardly below the drawer bottom panel 409.

In embodiments, cabinet panels 31, 33, 35, 36 and drawers 28 may comprise wood or wood products, such as hardwood, engineered wood, oriented strand board, plywood, or particle board. In embodiments, panels and drawers may be formed of alumina, aluminum alloys, magnesium alloys, steel, or other sheet metals or alloys known to one skilled in the art. In embodiments, drawers and panels may be comprised of plastics or polymers. In embodiments, panels and drawers may include any combination of wood and metal products. For example, a cabinet side panel may comprise particle board or plywood with a layer of melamine.

Continuing to refer to FIGS. 10 and 11A, a drawer 28 is in cabinet 24 in an extended position extending out of drawer opening 39. Molded polymer drawer guides 100 are installed on the upper surface of the cross member of the front panel such as with a fastener such as a wood screw 186 in opening 39 of cabinet 24. The wood screw has a conical head 187 that cooperates with the countersink 120 on the aperture 119 to position the screw flush with or below the surface 117 of the attachment portion 101. The longitudinal axis 109 of molded drawer guide is aligned with cross member 50, and downwardly facing contact surface 107 engages the cross member 50. Cabinet panel contact face 123 abuts the corresponding vertical edge portion surface 190 of cabinet 24 at the opening 39. Molded polymer drawer guide 100 may be affixed to cabinet 24 by inserting a single fastener 186 through aperture 119 and into cross member 50. In embodiments, fastener may be a nail. It will be appreciated by those skilled in the art that cabinet panel contact face 123 abutting the corresponding portion of cabinet opening 39 prevents molded drawer guide 100 from rotation about an axis defined by the fastener. Reduction of fasteners offers substantial cost and time savings when producing furniture items.

Figure 11B:
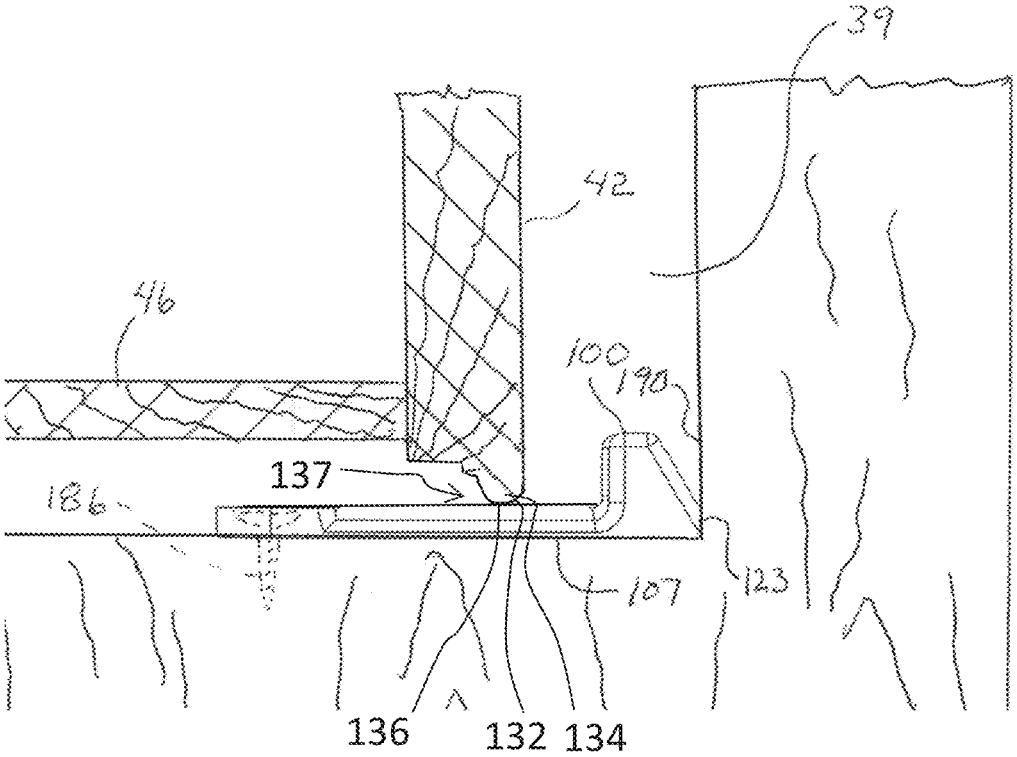
FIG. 11B is a partial cross sectional view of a drawer guide interfacing with a different drawer configuration as compared to FIG. 11A.

FIG. 11B illustrates an embodiment quite similar to the embodiment of FIGS. 10 and 11A with the side panels 42 of the drawer having a lower margin rounded engagement surface 132 on a projecting portion 134, when viewed in cross section, defining the rounded lower margin 136 of the side panel 42. The rounded projection portion 134 engaged with the arcuate convex surface 121 of the drawer guide 100 provides a smooth low friction interface 137 between the drawer and drawer guide.

Figure 12:
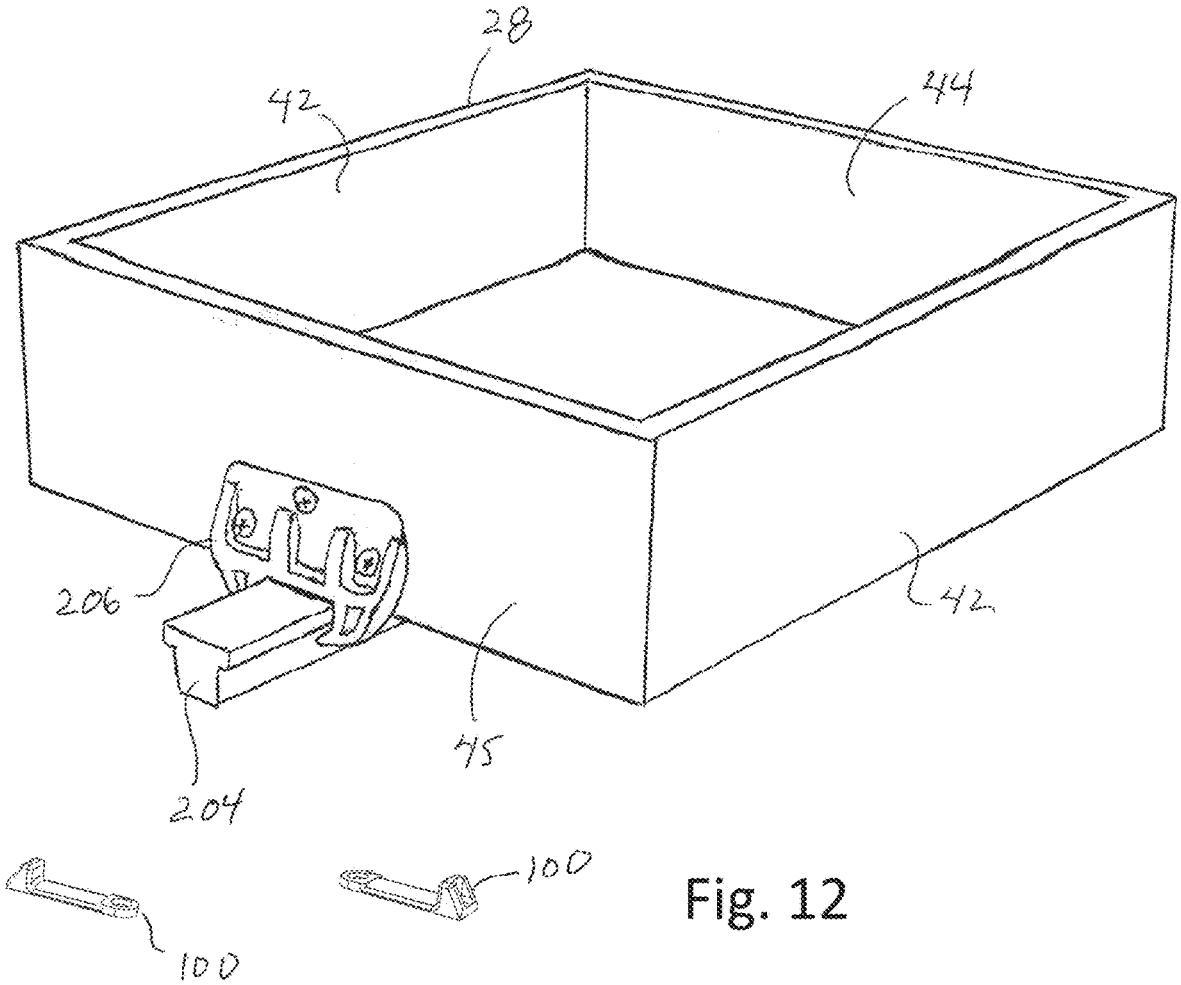
FIG. 12 is a perspective view of a drawer with a single central mount drawer slide assembly with guides according to embodiments of the disclosure.

FIG. 12 depicts a drawer 28 with an alternate central mounted drawer slide 200 comprising a wood rail 204 that is attachable to the cabinet and a bracket 206 that is illustrated attached to the rear panel 45. The bracket may be polymer or metal. In embodiments, a central mountable drawer slide assembly is furnished with a cabinet attachable rail 204 for attachment to the cabinet, a bracket or drawer rail attachable to the drawer, the bracket or drawer rail interfacing with and slidable along the cabinet mountable rail, and polymer drawer guides as disclosed herein.

A coefficient of friction between molded drawer guide 100 and drawer 28 is smaller than a coefficient of friction between drawer 28 and cabinet 24. As depicted in FIG. 5, drawer guide 100 prevents drawer 28 from directly contacting cabinet 24 and allows the drawer to glide as it is pulled out and pushed in. Any reduction in the coefficient of friction is welcome, as lowering the coefficient of friction improves operability of the drawers. Minimizing surface area of points of contact in this application is believed to further reduce the coefficient of friction. As shown, contact between drawer 400 and guide 100 is generally limited to gliding portion 105 in embodiments. In particular, contact occurs at the apex 123 of arcuate surface 121, thereby minimizing the surface area of contact points between drawer 400 and guide 100. This results in improved operability when opening and closing drawers 400 in cabinet 300.

When used herein, "cabinet" is not associated with any specific type of furniture item other than one with drawers and a front panel with drawer openings. Unless the context is to the contrary, the term cabinet is exclusive of the drawers for the particular piece of furniture, the cabinet receives the drawers. The term "portion" when used herein may be part of a component or part or all of the referenced component of part. Although embodiments shown herein are depicted as homogeneous, in embodiments, the drawer guide may be formed from two distinct polymers and may be, for example, overmolded. The following patents and patent publications are incorporated herein by reference for all purposes: U.S. Pat. No. 2,785,939; US2003/30155847; U.S. Pat. Nos. 3,650,592; 3,844,627; 3,365,261; 3,650,577; 3,846,001; 3,897,981; 3,701,577; and 3,658,394.

The invention is not restricted to the details of the foregoing embodiment(s). The invention extends to any novel one, or any novel combination, of the structure, components, elements, steps disclosed in this specification (including any such structure, components, elements, steps that are included in the patents and patent publications incorporated by reference herein). The above references in all sections of this application are herein incorporated by references in their entirety for all purposes. All of the structure, components, elements, steps disclosed, claimed, and specifically including such structure, components, elements, steps that included in the patents and patent publications incorporated by reference herein, and all of the structures, components, elements, and steps of any method or process so disclosed, may be combined in any combination Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above-described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A molded drawer guide for aligning a center mounted drawer within a cabinet, the drawer guide being elongate with an elongate axis, the drawer glide comprising:

an attachment portion on one end and a spacing portion on an opposite end with a gliding portion extending therebetween, the attachment portion, spacing portion, and gliding portion being unitary and having a common downwardly facing planar surface for mounting on an upwardly facing surface of a cabinet that defines a drawer opening in the cabinet;

wherein the attachment portion defines a pad with an upwardly facing surface with a central aperture for receiving a screw and further has an upright side surface extending about the pad from the upwardly facing surface to the common downwardly facing planar surface;

wherein the gliding portion has an upwardly facing convex surface such that a cross section through the gliding portion taken perpendicular to the elongate axis has a smooth upper convex curvature extending a length of the gliding portion, the convex surface of the gliding portion extending to the upright side surface of the attachment portion, a portion of the upright side surface of the attachment portion facing in a direction toward the spacing portion, and wherein the gliding portion having a length in the range of from 15 to 38 mm and the attachment portion having a length in the range of 12 to 15 mm, and wherein the spacing portion defines an upwardly projecting drawer contact face that faces towards the attachment portion, the upwardly projecting drawer contact face extending upwardly from the upwardly facing convex surface of the gliding portion, the spacing portion further having a cabinet panel contact face perpendicular to the downward facing planar surface and opposite from the upwardly projecting drawer contact face.

2. The molded drawer guide of claim 1, wherein the aperture of the pad has a countersink.

3. The molded drawer guide of claim 2, wherein a height of the pad surface equals a height of the gliding portion.

4. The molded drawer guide of claim 3, wherein a forward edge of the spacing portion tapers upwardly and has a recess facing upwardly and away from the drawer guide.

5. The molded drawer guide of claim 2, wherein the molded drawer glide has only a single aperture for mounting to a cabinet.

6. The molded drawer guide of claim 1, wherein a height of the attachment portion measured upwardly from the bottom surface does not exceed the height of the gliding portion measured upwardly from the common downwardly facing planar surface.

7. The molded drawer guide of claim 1, wherein the drawer guide is molded from a polymer comprising at least one of the set of: polyethylenes, polypropylenes, polyesters, nylons, fluoropolymers, polyvinylchlorides, and polystyrenes.

8. The molded drawer guide of claim 7, wherein the molded drawer guide is a first drawer guide and in combination with a second molded drawer guide of the same configuration, and further in combination with a cabinet having a rectangular drawer opening defined by a drawer frame portion of the cabinet, the drawer frame portion having an upwardly facing surface with the first molded drawer guide mounted at one end of the upwardly facing surface and the second molded drawer guide mounted on an opposite end of the upwardly facing surface.

9. The combination of claim 8, further comprising a drawer with a pair of side panels, the drawer seated on the first and second molded drawer guides, with one of the pair of side panels seated on the gliding portion of the first molded drawer guide and the other of the pair of side panels seated on a gliding portion of the second molded drawer guide.

10. A furniture item comprising a cabinet with a drawer therein, the cabinet formed of a pair of wood or wood product side wall panels and a front panel extending between the side wall panels, the front panel having a rectangular drawer opening defined by an upwardly facing surface, a downwardly facing surface and two opposing inwardly facing vertical surfaces with the drawer in the drawer opening;

wherein the cabinet further comprising a drawer slide centrally positioned beneath the drawer and slidably attaching the drawer to the cabinet, the drawer having two drawer side panels, the two drawer side panels having a drawer bottom panel extending therebetween, each of the downwardly extending drawer side panels having a downwardly facing lower margin positioned below the drawer bottom panel;

a pair of polymer drawer glides secured to the cabinet in the drawer opening, wherein each of the polymer drawer glides comprises a front panel attachment portion at one end of the polymer drawer glide and at an opposite end a spacing portion for engaging a respective one of the two opposing inwardly facing vertical surfaces defining the drawer opening, each of the pair of polymer door glides further comprising a gliding portion extending between and from the front panel attachment portion and the spacing portion, the gliding portion having an upwardly facing convex surface, extending to an upright side surface of the front panel attachment portion and further extending to an upwardly projecting drawer contact face of the spacing portion, the gliding portion of each of the pair of polymer drawer glides receiving one of the downwardly facing lower margins of one of the respective drawer side panels, each drawer glide further having a flat contact face for engaging a respective one of the two opposing inwardly facing vertical surfaces defining the drawer opening, wherein each polymer drawer glide is secured to the cabinet with only a single fastener connection.

11. The furniture item of claim 10, wherein each of the polymer drawer glides is secured to the cabinet with one of a staple or a wood screw extending through the respective front panel attachment portion of the two polymer drawer glides.

12. The furniture item of claim 10, wherein the front panel attachment portion of the polymer drawer glide comprises a countersunk aperture such that only a single screw received through the aperture secures each respective polymer drawer guide to the front panel of the cabinet.

13. The furniture item of claim 12, wherein the front panel has two lower corners of the front panel opening such that when the front panel attachment portion is fastened to the upwardly facing surface, the flat contact face of the polymer drawer glide inhibits the polymer drawer glide from rotating about the fastener as the drawer is opened and closed.

14. The furniture item of claim 13, wherein the spacing portion of each drawer glide extends upwardly from the partial cylindrical shaped gliding portion such that the respective side panel of the drawer is prevented from contacting the respective side wall panel of the cabinet.

15. The furniture item of claim 10, wherein each of the downwardly extending side panels of the drawer has a rounded lower margin that engages the gliding portion of the respective drawer glides.

16. The furniture item of claim 10, wherein a first coefficient of friction between the polymer drawer glide and the drawer side panels is less than a second coefficient of friction between the drawer side panels and the cabinet.

17. The furniture item of claim 10, wherein each of the polymer drawer glides has a generally "L" shaped profile.

18. A method of installing a drawer in a cabinet, the cabinet having a front panel rectangular drawer opening with an upwardly facing horizontal surface, and two inwardly facing vertical surfaces, the method comprising:

providing a first and a second molded elongate drawer guides, each of the first and second molded drawer guides having an attachment portion configured as a pad on one end and a spacing portion on an opposite end with a gliding portion extending therebetween, each of the attachment portion, the spacing portion, and the gliding portion having flat faces for engaging the horizontal and vertical surfaces of the cabinet, the gliding portion having a smooth upper convex surface extending a length of the gliding portion between the attachment portion and the spacing portion, the upper convex surface connecting to an upright side surface of the attachment portion and further connecting to an upwardly projecting drawer contact face of the spacing portion;

placing the first molded elongate drawer guide on the horizontal surface of the cabinet;

abutting the spacing portion of the first molded elongate drawer guide against one of the two inwardly facing vertical surfaces;

attaching the first molded elongate drawer guide to the cabinet on the upwardly facing horizontal surface utilizing only a single fastener extending through the attachment portion into the upwardly facing horizontal surface;

placing the second molded elongate drawer guide on the upwardly facing horizontal surface of the cabinet;

abutting the spacing portion of the second molded elongate drawer guide against the other of the two inwardly facing vertical surfaces;

attaching the second molded elongate drawer guide to the cabinet on the upwardly facing horizontal surface utilizing a single fastener extending through the attachment portion into the upwardly facing horizontal surface; and installing the drawer in the cabinet with each of two side panels of the drawer slidingly engaged with respective ones of the first and the second molded elongate drawer guides.

19. The method of claim 18, further comprising connecting the drawer to a center drawer glide mechanism while installing the drawer, the glide mechanism positioned below the drawer and centered between the two side panels of the drawer.

* * * * *